US006450923B1

(12) United States Patent
Vatti

(10) Patent No.: US 6,450,923 B1
(45) Date of Patent: Sep. 17, 2002

(54) APPARATUS AND METHODS FOR ENHANCED EXERCISES AND BACK PAIN RELIEF

(76) Inventor: Bala R. Vatti, 152 Wason Rd., Hudson, NH (US) 03051

( * ) Notice: Subject to any disclaimer, the term of this patent is extended or adjusted under 35 U.S.C. 154(b) by 0 days.

(21) Appl. No.: 09/418,349

(22) Filed: Oct. 14, 1999

(51) Int. Cl.[7] ..... A63B 21/00
(52) U.S. Cl. ..... 482/8; 482/51; 482/54
(58) Field of Search ..... 482/8, 9, 51, 54, 482/66–68, 72, 140

(56) References Cited

U.S. PATENT DOCUMENTS

| | | | | |
|---|---|---|---|---|
| 4,986,261 A | | 1/1991 | Iams | |
| 5,104,119 A | | 4/1992 | Lynch | 482/5 |
| 5,110,117 A | | 5/1992 | Fisher | |
| 5,460,586 A | | 10/1995 | Wilkinson | |
| 5,595,556 A | | 1/1997 | Dalebout | |
| 5,626,538 A | | 5/1997 | Dalebout | |
| 5,662,560 A | | 9/1997 | Svendsen | |
| 5,704,881 A | | 1/1998 | Dudley | |
| 5,803,874 A | * | 9/1998 | Wilkinson | 482/54 |
| 5,839,998 A | * | 11/1998 | Wilkinson | 482/140 |
| 5,871,421 A | | 2/1999 | Trulaske | |
| 5,899,834 A | * | 5/1999 | Dalebout et al. | 482/54 |
| 6,174,270 B1 | * | 1/2001 | Dagenais | 482/148 |
| 6,217,483 B1 | * | 4/2001 | Kallassy | 482/38 |

* cited by examiner

*Primary Examiner*—Glenn E. Richman

(57) ABSTRACT

People suffering from back pain would be able to use the apparatus more effectively to relieve the pain. This apparatus can also be used by common users for strengthening and stretching exercises that conventional exercising equipment such as treadmills do not provide. Combinations of a general frame along with multiple attachments form an effective exercising apparatus. The user of the apparatus shifts weight from the spine or lower back to hands while performing exercises. Ordinary upright position causes more stress on the lower back, and the weight of the upper body in motion may make the situation worse. By suitable placement of hands and selectively distributing upper body weight to hands, the user would be able to control the amount of weight reduction on the lower back or spine as needed to achieve the best results and comfort.

39 Claims, 9 Drawing Sheets

APPARATUS AND METHODS FOR ENHANCED EXERCISES AND BACK PAIN RELIEF

FIELD OF THE INVENTION

The invention relates to an apparatus for exercises that relieve back pain and enhance strength and stretching in both lower and upper body.

BACKGROUND OF THE INVENTION

In general, most occupations involve either sitting, standing, walking or even worse, carrying weights while in motion. In these situations the lower part of the spine or lower back carries a person's upper body weight most of the time. All these activities add stress to the lower back constantly, and hence most people suffer from lower back pain one time or an another.

This invention is a result of my personal experience. I have had lower back pain for the past several years. I have taken physical therapy and performed various exercises to relieve my back pain. All my attempts failed to produce satisfactory results because of their unsuitability for my back pain or due to inconvenience.

By the end of the day I tend to lie down because of my back pain, and thus impairing all other needed activity. I also tend to exercise less since it was not really helping me because of increased stress on my back while exercising. I have tried various types of conventional treadmills and exercising bicycles at home, at work and fitness centers. However, all the equipment I tried failed to relieve my back pain effectively.

I wanted to shift my upper body weight to my hands while changing my walking posture, in order to relieve my back pain and to achieve effective upper-body exercises. However, the placement of any hand supports or their design failed to offer my intended purpose.

Prior art related to reducing load on the spine or increasing upper body strength failed to effectively address the stated issues. U.S. Pat. No. 4,986,261 issued to lams et al, on Jan. 22, 1991, discloses an apparatus for walking in spine unloaded state, U.S. Pat. No. 5,704,,881 issued to Dudley on Jan. 6, 1999, discloses an apparatus for counterbalancing gravitational forces on the spine, and U.S. Pat. No. 5,110, 117 issued to Fisher, et al. on May 5, 1992, discloses a treadmill with pivoting handles for arm exercises. None of the patents discloses any means for relieving back pain or the means of achieving certain postures specified in my current invention for stretching and strengthening exercises.

BRIEF DESCRIPTION OF THE INVENTION

I experimented various walking postures on a treadmill while shifting my upper body weight on to my hands in order to relieve my back pain as well as exercising some portions of my body that were not otherwise exercised. The weight shifting was achieved by using a well supported horizontal hand bar running across the walking belt. The bar could be placed at different heights along the belt.

Positioning the horizontal hand bar below my waist level while transferring my upper body weight to the bar caused my spine to bend forward, this has stretching effect on my spine. By transferring my upper body weight to the bar, using my hands caused reduction in axial loading of my spine. Walking under these conditions would give good massaging effect on my lower back, which would relieve my pain.

The relative positioning of the hand bar with respect to the walking belt resulted in some postures, which provided additional stretching and strengthening effects on both my upper and lower body.

All my experiments and together with my experience using the conventional exercising equipment resulted in my current invention.

The apparatus primarily consists of:

Two rigid vertical posts, each of which is positioned and locked along a rigid rail in a desired position. The rails are attached on the left and right sides of a treadmill belt frame. This forms the primary assembly for the purpose of this description. Several individual attachments to the vertical posts, separately or in a suitable combination, would provide effective exercises.

The first one is a rigid horizontal hand support bar of a suitable cross-section to provide proper grip and comfort while exerting body counter weight forces through hands. The horizontal bar is perpendicular to the motion of the belt.

The above apparatus, thus, facilitates positioning of the hand bar anywhere along the length of the belt and at any height permitted by the vertical supports. The bar together with the supports is capable of supporting the entire weight of the user.

Though several positions are possible to suit individual needs, we can consider the following four primary positions for the purpose of understanding its operation: 1. Front-middle position, 2. Front-lower position, 3. Middle-middle position, 4. Middle-upper position.

In position 1, the hand bar is close to the front edge of the belt, and at a height between the waist and the knee of the user. The user places hands on the hand bar spreading at a comfortable position along the bar, then exerts downward pressure as needed to relieve weight on the lower back while walking at a desired speed. The body may be bent forward slightly to stretch the spine. Quick relief of lower back can be realized in this operation, while exercising both upper and lower body muscles.

In position 2, the hand bar is lowered to below the knee level of the user. In this position, the spine of the user becomes more horizontal and the axial forces due to body weight on the spine will be reduced significantly. The body weight will be shifted to both hands and legs more evenly, which stretches the spine, which also exercises arm and shoulder muscles. Stretching legs as far back as possible while walking causes increased stretching in the hamstrings.

In position 3, the hand bar is raised above the shoulder level, and the posts are moved closer to the middle of the treadmill. The user shifts the load from the lower back to the bar by applying downward force on the bar by pulling the bar down. Again, the user adjusts the load on the bar as needed for the best results.

In position 4, the bar is raised up to the maximum level where the user stretches arms up almost fully. Higher positions provide stretching in the arms and the upper body, similar to chin-ups, while reducing load on the spine for comfortable walk. This will also help stretching in the spine. In this position the user is almost suspended from the hand bar to reduce weight on the spine as well as leg joints.

The treadmill can be inclined forward or backward to achieve the results of strength and stretching exercises in various parts of the body. This facilitates both uphill and downhill walking while adjusting the forces against gravity using the hand support, which results in postures, and hence exercises, that are not provided by conventional treadmills.

Inclinations may be steeper than what the conventional treadmills offer.

It is also an object of the invention to facilitate natural movement of the arms through a pair of swinging arm attachments. These can be attached to the vertical supports typically at shoulder level. The arm of the attachment is pivotally attached to provide full circular motion as well as swings closer and away from the user as needed. Resistance and the freedom of the individual direction of rotation or swing can be adjusted as needed. In addition, the length of the arm can be adjusted to suit individual needs. Also, shock absorbing means provided will reduce shock while weight shifting. This attachment allows the user to swing hands more naturally while walking in different postures.

It is an additional object of the present invention to provide an adjustable platform to serve various utility functions such as holder for a book, TV, display, and controls. The user will be able to position and orient these more ergonomically as needed. The controls may include wired or wireless apparatus to control functions of various visual, sensory and motion equipment.

It is another object of the invention to accommodate when one of user's legs is unable to function. An attachment to serve as a footrest can be positioned at a convenient height along one of the posts should the user find it necessary to rest one of the legs. Additional spring action will provide necessary cushioning effect while the other leg and the rest of the body is working out.

Another object of the invention is to provide an adjustable attachment for an air circulating equipment such as a fan or air conditioner to minimize perspiration and help prolonged workout. The attachment can be oriented and locked at a convenient height along the posts.

Another object of the invention is to provide for programmed functioning of all the attachments such as automatic and periodic movement of the hand bar as well as the vertical supports to be able to exercise more effectively for desired results. Various input parameters can be measured for monitoring and controlling the apparatus for safe and effective operations.

It is another object of the invention to provide a cost-effective solution. The basic apparatus that permit most of the stated exercises can be build with only a small additional cost to an existing treadmill or bicycle as an attachment. It is also easy to manufacture and assemble the parts. The complete apparatus, which offer automatic and power driven movements of the parts, may be manufactured using the existing technology.

DETAILED DESCRIPTION OF THE PREFERRED EMBODIMENTS

The preferred embodiments herein presented are chosen and described to explain the invention so that others skilled in the art might use its merits. They are not intended to be exhaustive or to limit the invention to the precise form disclosed.

Figure 1:
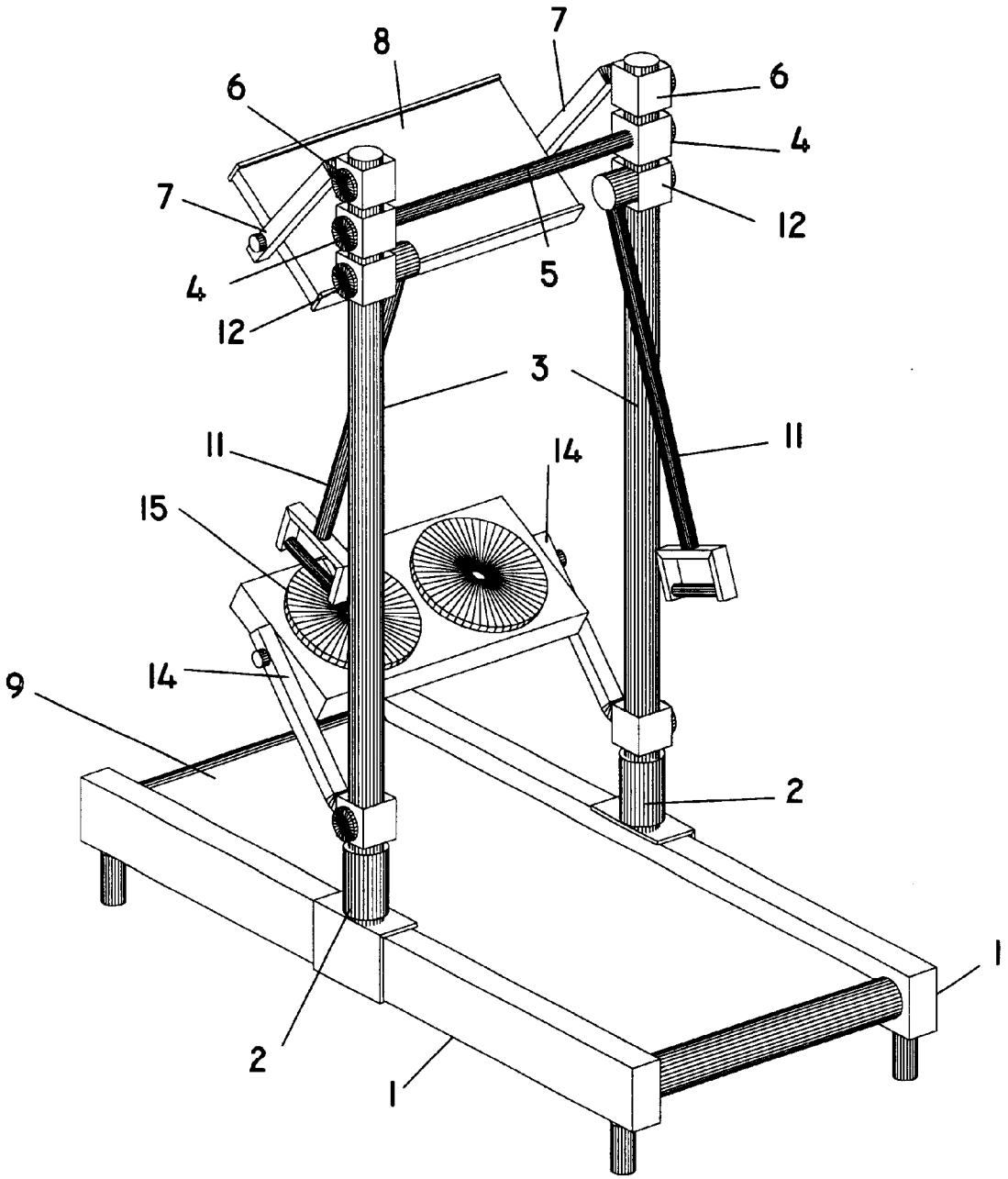
FIG. 1 shows a perspective view showing the apparatus with a hand bar, a hand swing, a utility platform, and a fan assembly.

FIG. 1 shows one embodiment of the invention in a perspective view showing the apparatus with a hand bar, a hand swing, a utility platform, and a fan assembly. Vertical support posts 3, are locked in approximately a middle position along rails 1, attached to the left and the right sides of the walking belt 9, of a treadmill. Posts 3, can slide and lock in a position along rails. 1, by means of rigid rail joints 2. Joints 2, may also contain a motor driven gear mechanism, pneumatic means, or cable means to move posts 3, along rails 1, and move any of the attachments vertically along posts 3. Rails 1, may further include cogs, a threaded drive shaft, or cable and pulleys to facilitate the movements.

Hand bar 5 is at an upper level locked in position at the joints 4, attached to the vertical support posts 3. The hand bar may rotate about its axis, and the resistance of rotation may be selectively varied by elastic or frictional means. This rotation will provide additional exercise to the user's wrists and forearms individually or in combination with other exercises.

Figure 8:
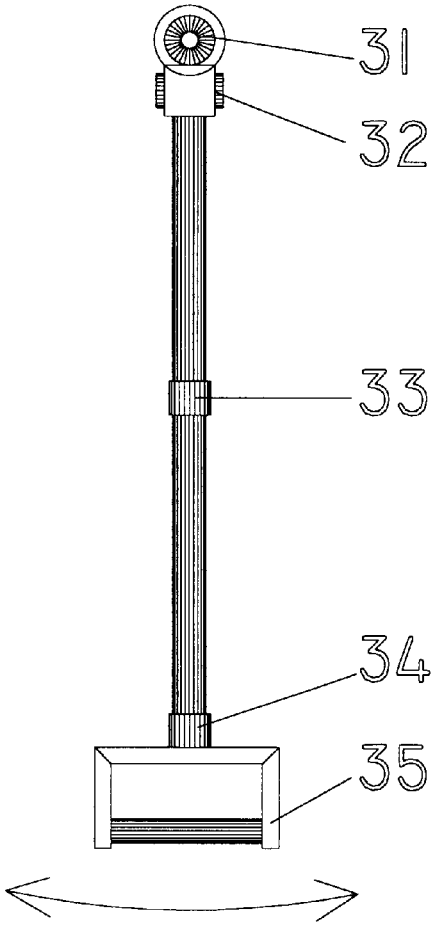
FIG. 8 shows a side elevation view of the hand swing.
Figure 9:
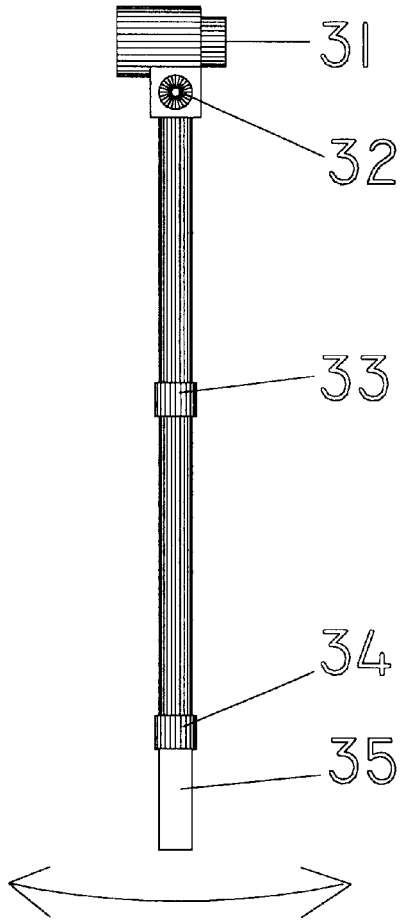
FIG. 9 shows a front elevation view of the hand swing.

A pair of hand swings 11, which may be attached approximately at user's shoulder level to the posts 3 to facilitate natural arm movements while exercising. The hand swings are pivotally mounted to posts 3, by joints 12. The pivotal means provides rotation of the hand swings along two perpendicular axes. Resistance of rotation along the two axes may be independently and selectively varied by frictional or elastic means. In addition to providing arm exercises, the hand swings also facilitate selectively shifting of upper body weight to the hands by adjusting the vertical height of swing joints 12. Details of the hand swings are shown in FIG. 8 and FIG. 9.

A fan assembly 15, is pivotally attached to the posts 3 at a desired height, by means of extensible support arms 14. The fan assembly 15, therefore, can be positioned and oriented to provide comfortable airflow to the user while working out.

Adjustable utility platform 8, is attached at a desired height along posts 3, using platform joints 6. Platform 8 is pivotally mounted to platform arms 7 and locked at a position along its length. This platform assembly provides comfortable height and orientation for the user. Each side of platform 8, may be used for supporting one or more of the components such as electronic controls, monitoring devices, a television, a book, and a computer. Platform 8, provides an ergonomic means for placement of such components.

Figure 2:
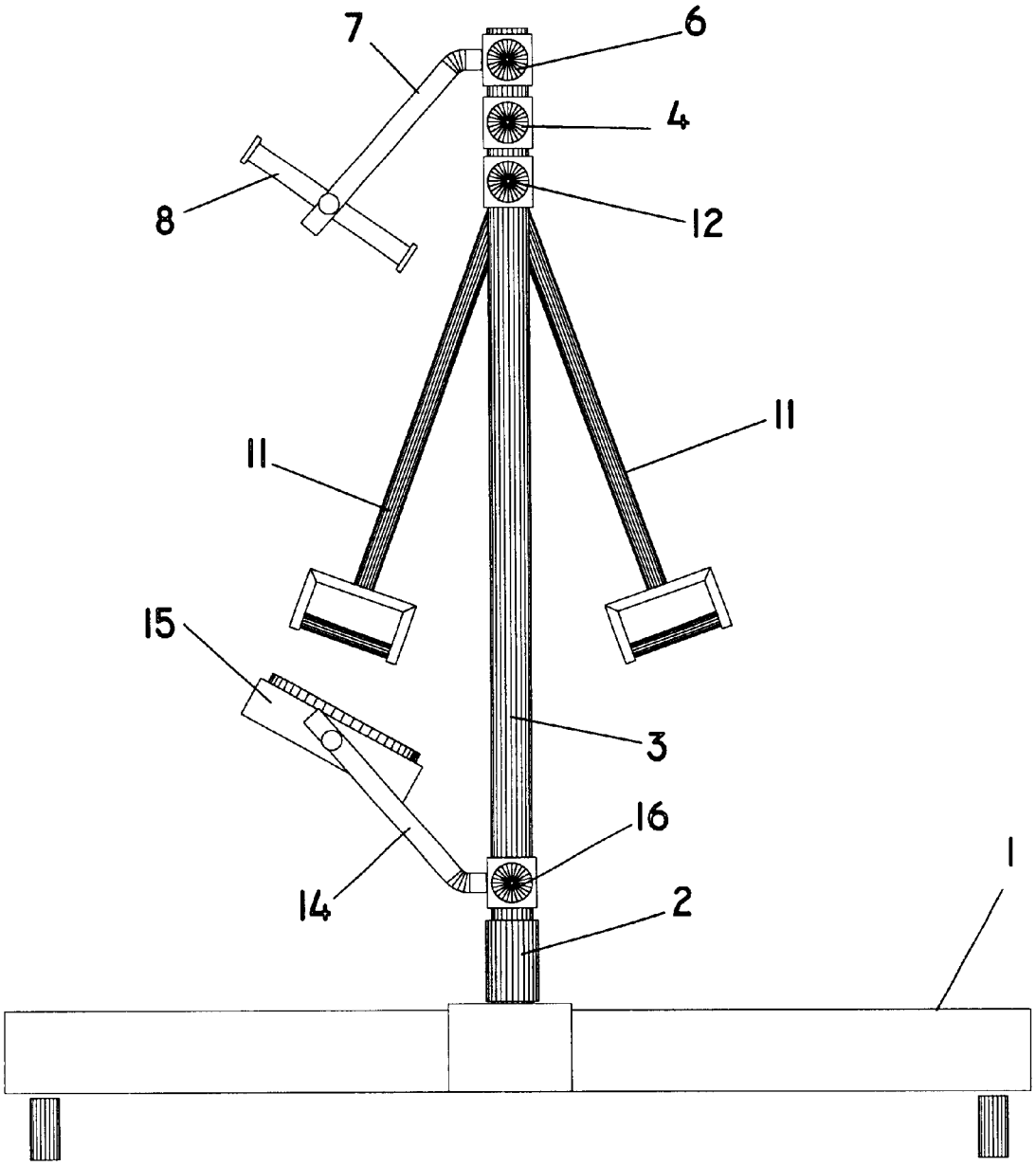
FIG. 2 shows a side elevation view of the apparatus of FIG. 1

FIG. 2 shows the embodiment of FIG. 1 in a side elevation view. This shows rail 1, rail joint 2, post 3, hand bar joint 4, platform joint 6, platform support arm 7, utility platform 8, hand swings 11 in a rotated position, hand swing joint 12, fan assembly support arm 14, fan assembly 15, and fan assembly joint 16.

Figure 3:
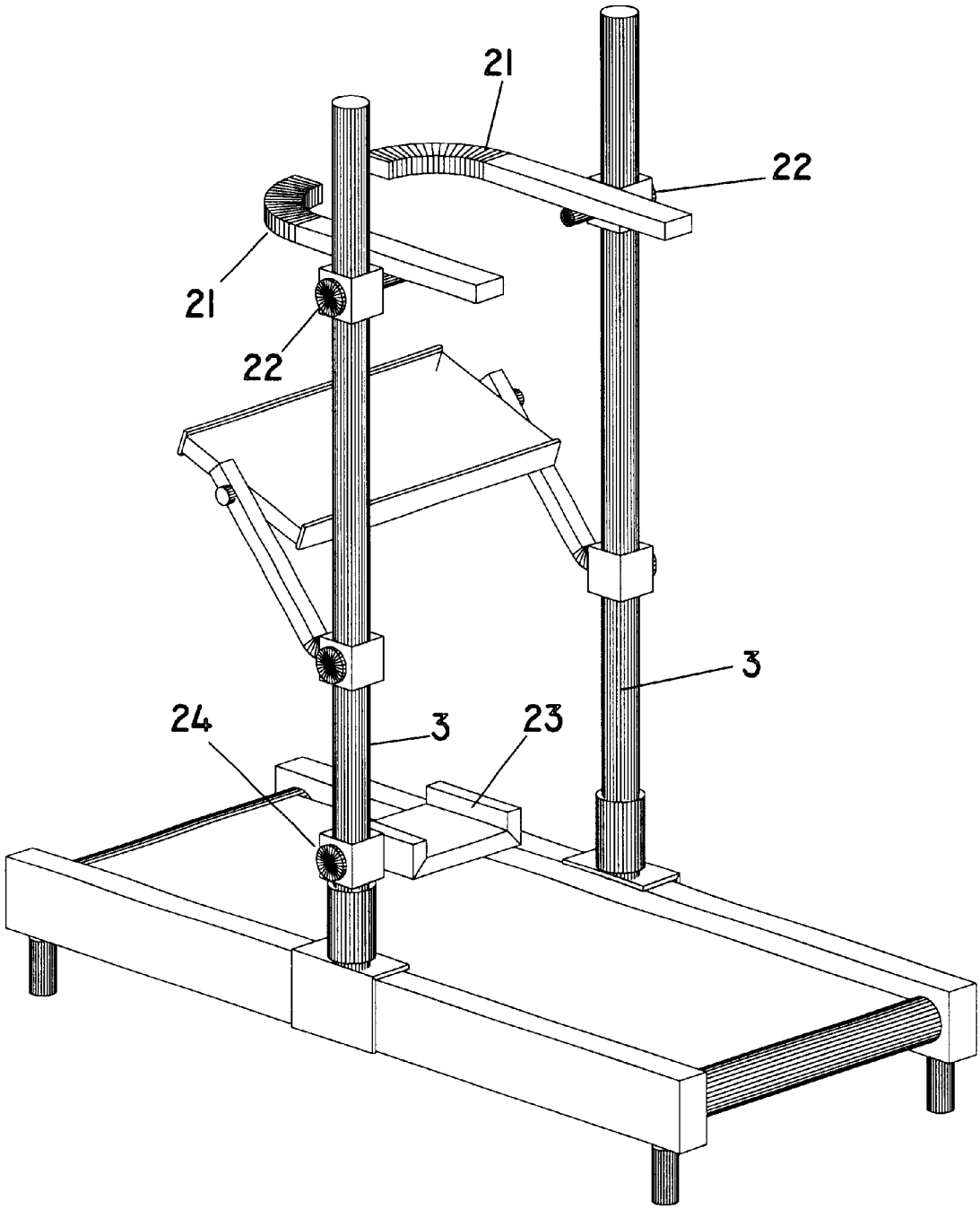
FIG. 3 shows another form of the hand bar, and a support for a lower limb.

FIG. 3 shows a perspective view of an embodiment consisting of hand and underarm supports 21 for both left and right hands. These supports provide means for selectively transferring upper body weight to posts 3 through underarms and forearms while performing exercises. Support joints 22, provide means of locking along posts 3 at a desired height. Posts 3 are positioned conveniently in the middle along the treadmill belt. Suitable shape and shock absorbing means may be provided to supports 21, in order to support underarms and hands comfortably. FIG. 3 also shows foot or leg resting means in the event the user is unable to use one of the lower limbs due to temporary or permanent inability.

FIG. 4, FIG. 5, FIG. 6 and FIG. 7 show hand bar 5 in four different exemplary positions using joints 6 along posts 3, in order for the user to achieve different effects while exercising.

Figure 4:
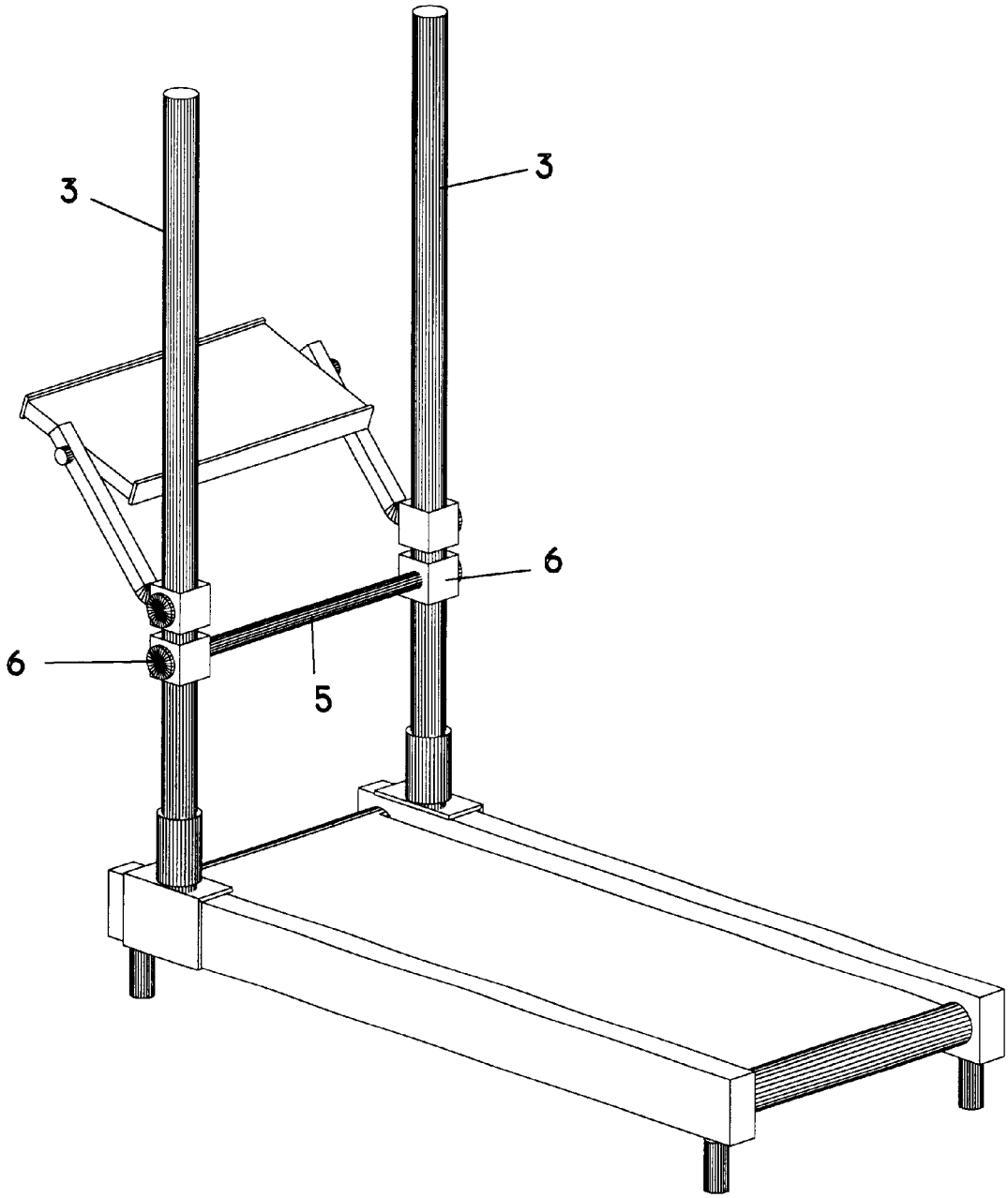
FIG. 4 shows the hand bar in front-middle position.

FIG. 4 shows hand bar 5 in a front-middle position. Posts 3 are locked in a front position, and hand bar 5 is locked at a level which is below user's waist and above the knee. The user places hands on the hand bar spreading at a comfortable position along the bar, then exerts downward pressure as needed to relieve weight on the lower back while walking at a desired speed. The body may be bent forward slightly to stretch the spine. Quick relief of lower back can be realized in this operation, while exercising both upper and lower body muscles.

Figure 5:
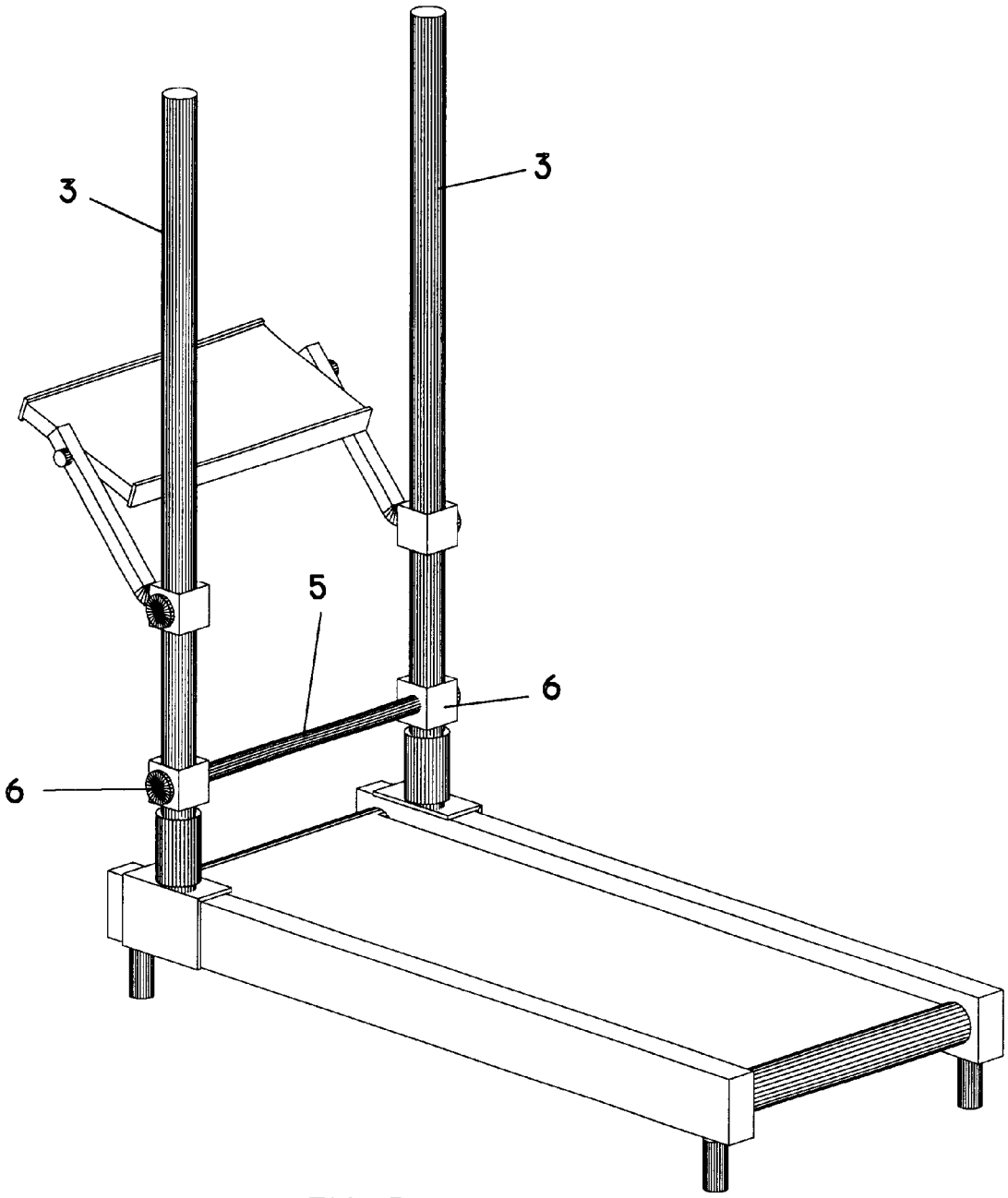
FIG. 5 shows the hand bar in front-lower position.

FIG. 5 shows hand bar 5 in a front-lower position. Posts 3 are locked in a front position, and hand bar 5 is locked at a level which is below user's knee. In this position, the spine of the user becomes more horizontal and the axial forces due to body weight on the spine will be reduced significantly. The body weight will be shifted to both hands and legs more evenly, which stretches the spine, which also exercises arm and shoulder muscles. Stretching legs as far back as possible while walking causes increased stretching in the hamstrings.

Figure 6:
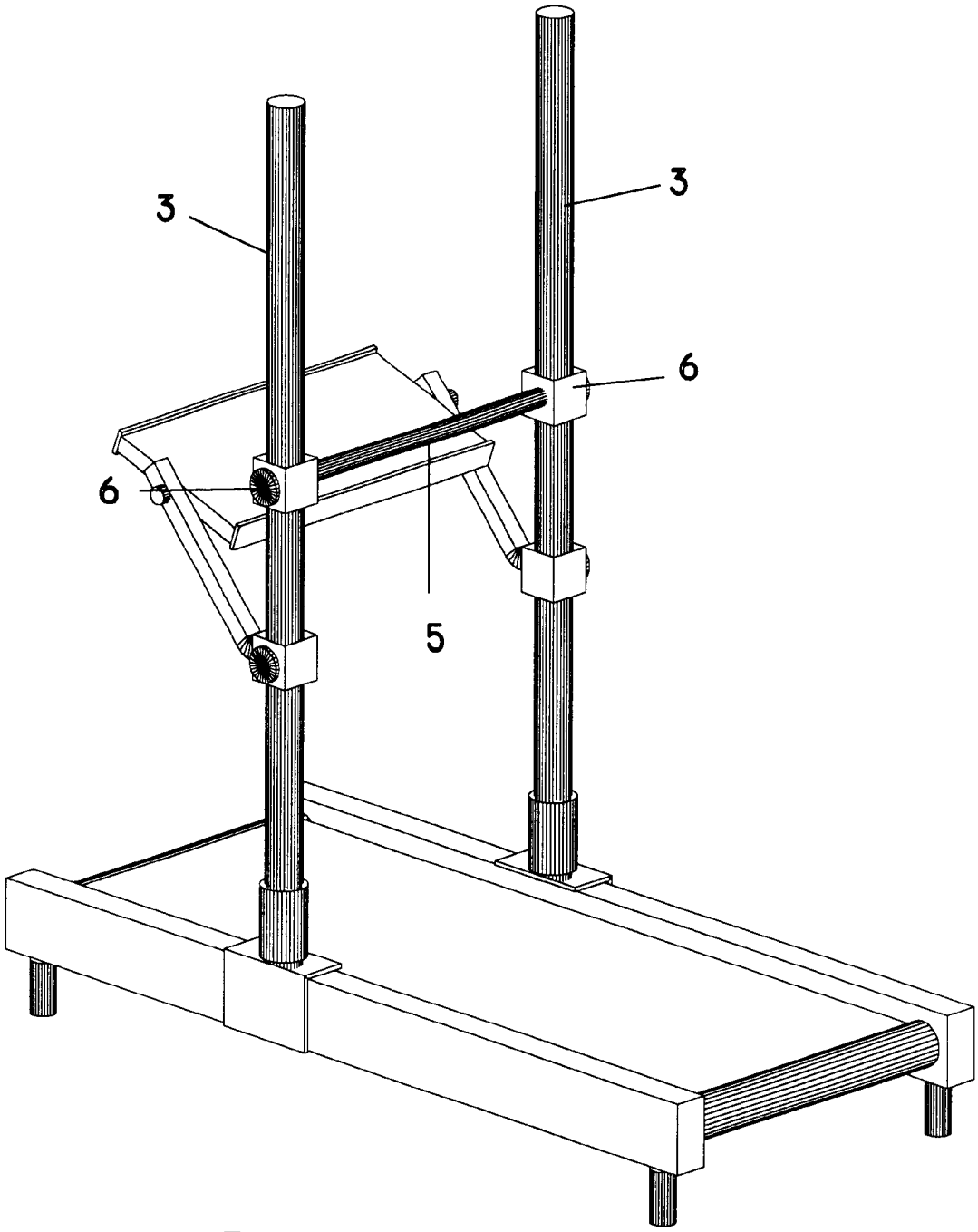
FIG. 6 shows the hand bar in middle-middle position.

FIG. 6 shows hand bar 5 in a middle-middle position. Posts 3 are locked in a front position, and hand bar 5 is locked at a level which is above user's waist and below user's head level. The user shifts the load from the back to the bar by applying downward pressure on the bar by pulling the bar down. Again, the user adjusts the load on the bar as needed for the best results.

Figure 7:
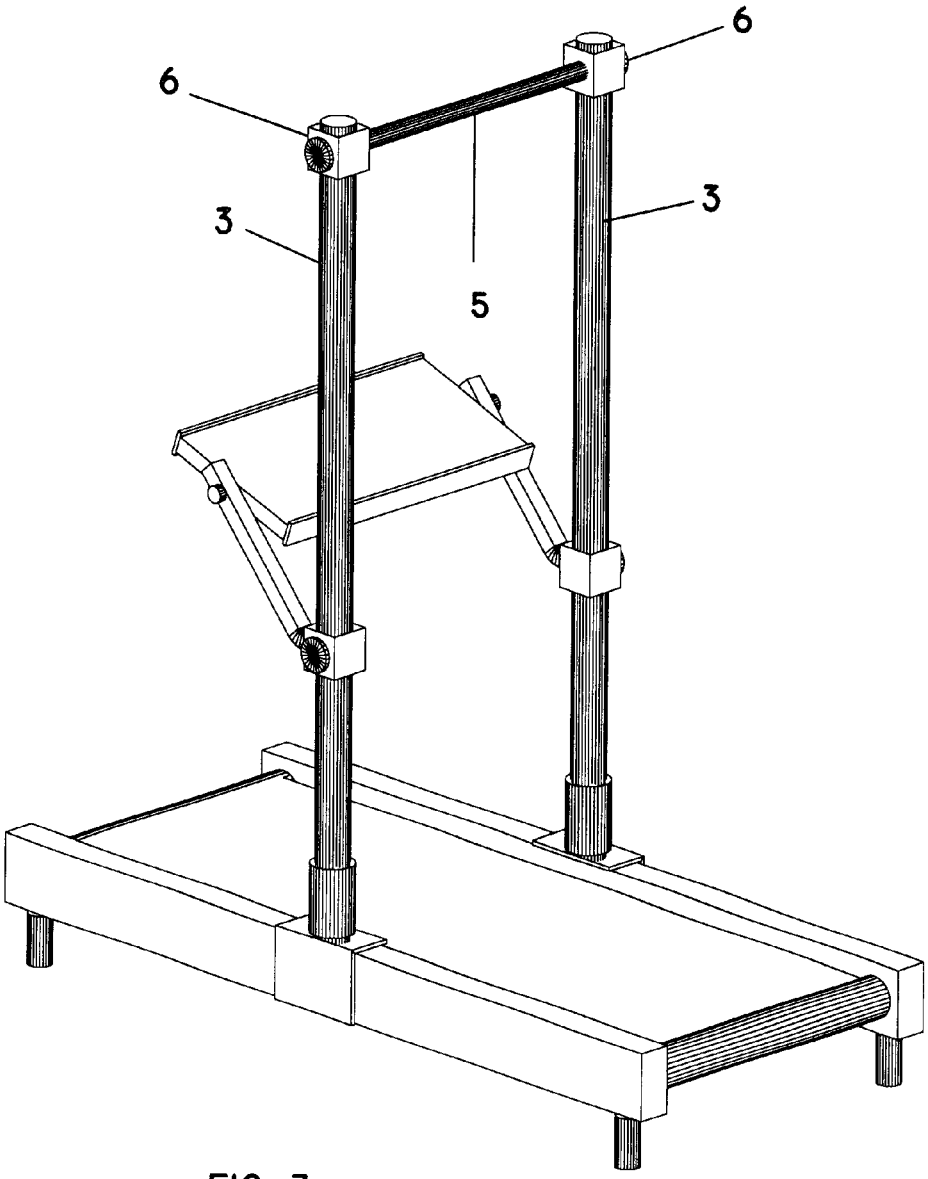
FIG. 7 shows the hand bar in middle-upper position.

FIG. 7 shows hand bar 5 in a middle-upper position. Posts 3 are locked in a front position, and hand bar 5 is locked at a level where the user's hands are almost fully stretched vertically up. Higher positions provide stretching in the arms and the upper body, similar to chin-ups, while reducing load on the spine for comfortable walk. This will also help stretching in the spine. In this position, the user is almost suspended from the hand bar to reduce weight on the spine as well as leg joints.

FIG. 8 and FIG. 9 show the details of the hand swing 11, of FIG. 1. FIG. 8 is a side elevation view and FIG. 9 is a front elevation view. Knob 31, is a means for adjusting resistance in front and back swing movements. Knob 32, is a means for adjusting resistance in left and right swing movements. Knob 33 is a means for adjusting the length of the swing arm to suit the user's needs. Knob 34, provides a means for adjusting the shock absorbing resistance while swinging and transferring upper body load to the handles 35, by adjusting the opposing force of an internal spring.

Figure 10:
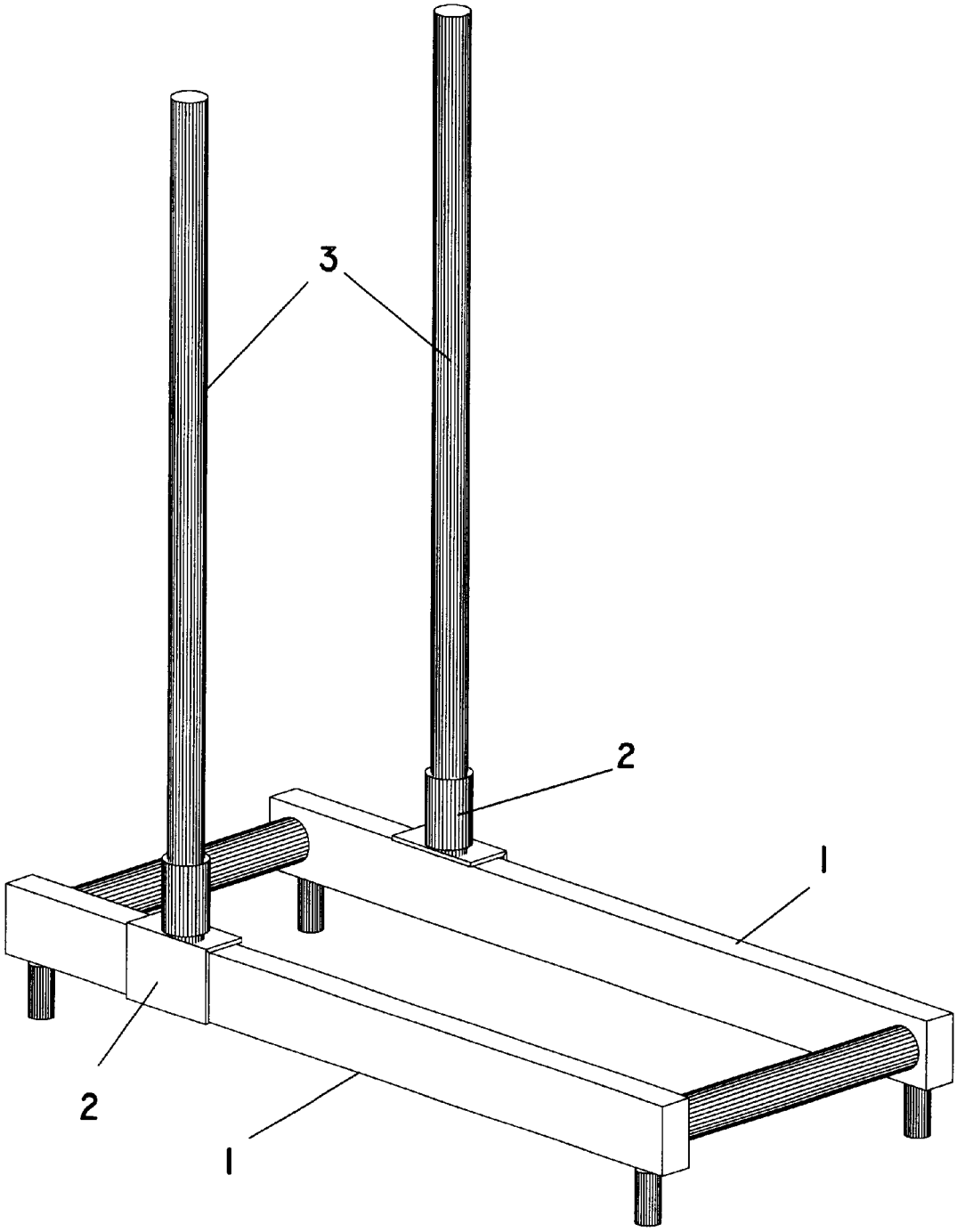
FIG. 10 shows a perspective view of the frame.

FIG. 10 shows a perspective view of the frame of the apparatus, which includes a base with two side rails 1, rail joints 2, and vertical support posts 3. The frame along with the any suitable combination of the stated attachments could be used with an existing treadmill or an exercise bicycle for some or all of the exercises described above.

What is claimed is:

1. An exercise apparatus for use in combination with a leg movement exercise device, wherein the exercise apparatus is used for supporting and optionally exercising the upper body of a user while the user performs leg exercises, said apparatus comprising:

a floor frame for accommodating said leg movement exercise device, the floor frame having a front side, a back side, a left side and a right side with respect to the user's general orientation while performing leg exercises;

a support frame having at least one pair of substantially vertical members, said pair having a left vertical member and a right vertical member separately attached to the left side and the right side of the floor frame;

a frame attachment member; and two attachment mechanisms for adjustably attaching the frame attachment member at two separate sections thereof to the pair of substantially vertical members at a desired height, wherein the frame attachment member is configured to support and optionally exercise the upper body of the user while the user performs leg exercises.

2. The exercise apparatus of claim 1, wherein the floor frame has a left frame member on the left side and a right frame member on the right side, and wherein each of the left and right frame members has a length extending between the front side and the back side of the floor frame, and a securing device for adjustably attaching the two substantially vertical members along the length of the left and right frame members.

3. The exercise apparatus of claim 1, wherein the leg movement exercise device comprises a treadmill having a walking belt.

4. The exercise apparatus of claim 3, further comprising a foot rest adjustably attached to one of the substantially vertical members and positioned for supporting one of the user's feet when the user keeps said foot off the walking belt while performing leg exercises with the other leg.

5. The exercise apparatus of claim 1, wherein the leg movement exercise device comprises an exercising bicycle.

6. The exercise apparatus of claim 1, wherein the attachment mechanisms are adjustable to change the desired height.

7. The exercise apparatus of claim 6, further comprising a mechanism for automatically and periodically adjusting the attachment mechanisms to change the desired height.

8. The exercise apparatus of claim 1, wherein the frame attachment member comprises a horizontal hand bar.

9. The exercise apparatus of claim 8, wherein the attachment mechanisms comprise means for automatically and periodically adjusting the desired height of the horizontal bar.

10. The exercise apparatus of claim 8, wherein the hand bar has a suitable shape to support the user's upper body at underarm, elbow or palm level and has means to adjust proximity to the left and right sides of the user, whereby the user can shift upper body weight from the spin to the underarm, elbow or palm under varying postures.

11. The exercise apparatus of claim 1, wherein the frame attachment member comprises a first swinging arm and a second swinging arm, each having a first end and a second end and a handle on the second end, wherein the first swinging arm is pivotably attached at the desired height to the left vertical member at the first end of the first swinging arm, and a second swinging arm is pivotably attached to the right vertical member at the first end of the second swinging arm at the desired height by the attachment mechanisms.

12. The exercise apparatus of claim 11, wherein the first and second swinging arms each has an adjustable length.

13. The exercise apparatus of claim 11, wherein the frame attachment member further comprises a horizontal hand bar attached to the support frame at a height different from the desired height.

14. The exercise apparatus of claim 1, further comprising at least one sensor for measuring one or more of the following parameters: the user's weight distribution, positions of the attachment mechanisms, the user's pulse rate, the user's blood pressure, speed of the user's leg movement, duration of the user's leg exercises, number of repetitions of the user's leg exercises, and resistance to the user's leg movement.

15. The exercise apparatus of claim 14, further comprising a visual display unit adjustably mounted on the support frame and positioned at a selected height and orientation for displaying said one or more parameters.

16. The exercise apparatus of claim 14, further comprising an adjustment mechanism for adjusting the desired height of the attachment mechanisms, and a computing device operatively connected to said at least one sensor and the adjustment mechanism so as to cause the adjustment mechanism to adjust the desired height based on the one or more parameters as measured by said at least one sensor.

17. The exercise apparatus of claim 1, further comprising means for receiving wireless signals for operating the exercise equipment from a remote control device providing convenient access for adjustments.

18. An exercise apparatus comprising:

a leg movement exercise device;

a floor frame for accommodating said leg movement exercise, the floor frame having a front side, a back side, a left side and a right side with respect to a user's general orientation while the user performs leg exercises;

a support frame having at least one pair of substantially vertical members, said pair having a left vertical member and a right vertical member separately attached to the left side and the right side of the floor frame;

a frame attachment member; and two attachment mechanisms for adjustably attaching the frame attachment member at two separate sections thereof to the pair of substantially vertical members at a desired height, wherein the frame attachment member is configured to support and optionally exercise the upper body of the user while the user performs leg exercises.

19. The exercise apparatus of claim 18, wherein the floor frame has a left frame member on the left side and a right frame member on the right side, and wherein each of the left and right frame members has a length extending between the front side and the back side, and a securing device for adjustably attaching the two substantially vertical members along the length of the left and right frame members.

20. The exercise apparatus of claim 19, further comprising a movement means, operatively connected to the securing device, for moving the securing device along the length of the left and right frame members for providing a discrete or continuous sliding movement of the left and right vertical members along the respective frame members.

21. The exercise apparatus of claim 20, wherein the movement means comprises a motor.

22. The exercise apparatus of claim 20, wherein the movement means comprises a pneumatic pump.

23. The exercise apparatus of claim 18, wherein the frame attachment member comprises a hand support bar, allowing the user to shift upper body weight to the hand support bar using hands while performing leg exercises, thereby relieving axial force on the user's spine.

24. The exercise apparatus of claim 23, wherein the hand support bar is rotatable about the longitudinal axis thereof to allow the user to exercise the user's wrists and forearms by turning the hand support bar, and the support bar is capable of providing an adjustable resistance force against said turning.

25. The exercise apparatus of claim 18, wherein the frame attachment member comprises a hand swing, allowing the user to shift upper body weight to the hand swing using the user's hands.

26. The exercise apparatus of claim 25, wherein the hand swing comprises two swinging arms, and wherein each of the two attachment mechanisms comprises means for pivotally attaching one of the swinging arms to one of the substantially vertical members providing at least one axis of rotation for allowing the user's arms to swing in natural arm swing motion while performing leg exercises, thereby relieving axial force on the user's spine.

27. The exercise apparatus of claim 26, wherein the pivotally attaching means is capable of providing adjustable resisting force against the arm swing motion.

28. The exercise apparatus of claim 18, wherein the user has one disabled lower limb, said exercise apparatus further comprising a footrest adjustably attached to one of the substantially vertical members for allowing the user to rest the disabled limb on the footrest while the user performs leg exercises.

29. The exercise apparatus of claim 18, wherein the leg movement exercise device comprises a treadmill.

30. The exercise apparatus of claim 18, wherein the leg movement exercise device comprises an exercising bicycle.

31. The exercise apparatus of claim 18 further comprising a utility platform, which is attached to the support frame at a selected height according to the height and orientation of the user, for supporting a book, an audio/visual device or the like.

32. The exercise apparatus of claim 18, further comprising an air circulating device adjustably mounted on the support frame, whereby allowing the user to exercise longer periods due to increased comfort.

33. A method of reducing load on lower back and lower joints, reducing back pain of a person, said method comprising the steps of:

performing leg exercises on a leg movement excise device; and supporting and optionally exercising the upper body of said person using a support apparatus while said person performs leg exercises, wherein the support apparatus comprises:

a floor frame for accommodating the leg movement exercise device;

a support frame secured to the floor frame; and a frame attachment member adjustably attached to the support frame at a desired height and configured to support and optionally exercise the upper body.

34. The method of claim 33, wherein the floor frame has a front side, a back side, a left side and a right side with respect to said person's general orientation while performing leg exercises, and the support frame has at least one pair of substantially vertical members, said pair having a left vertical member and a right vertical member separately attached to the left side and the right side of the floor frame; and wherein the support apparatus further comprises two attachment mechanisms for adjustably attaching the frame attachment member at two separate sections thereof to said pair of substantially vertical members at the desired height.

35. The method of claim 33 wherein the frame attachment member comprises a hand bar, and wherein the supporting and optional exercising step comprises the steps of:

holding the hand bar; and distributing a self-selective portion of the upper body weight from said person's spine to the hand bar by applying downward force on the hand bar.

36. The method of claim 35, wherein the hand bar is positioned at a level below said person's waist, whereby stretching said person's spine while relieving axial force on the spine due to the upper body weight, and cantilever force due to bending.

37. The method of claim 33, wherein the hand bar is positioned at a level above said person's waist, whereby allowing said person to remain in an upright posture while said person shifts portion of the upper body weight from the spine to the hand.

38. The method of claim 33, wherein the leg movement exercise device comprises a treadmill having a walking belt, and wherein the leg exercising step comprises stretching the leg moving with walking belt far enough rearward, while keeping the heel of said leg close to the walking belt, whereby providing stretching in the hamstrings in said leg.

39. The method of claim 33, wherein the leg movement exercise device comprises a stationary bicycle.

* * * * *

UNITED STATES PATENT AND TRADEMARK OFFICE

CERTIFICATE OF CORRECTION

PATENT NO. : 6,450,923 B1
DATED : September 17, 2002
INVENTOR(S) : Bala R. Vatti It is certified that error appears in the above-identified patent and that said Letters Patent is hereby corrected as shown below:

Title page,
Item [54], Title, should be -- APPARATUS FOR BACK PAIN RELIEF AND ENHANCED EXERCISES --

Column 1,
Line 41, please replace “lams” with -- Iams --.

Column 4,
Line 15, after “rails”, please delete “.”.

Signed and Sealed this

Sixteenth Day of March, 2004

JON W. DUDAS
*Acting Director of the United States Patent and Trademark Office*